US010131066B2

(12) United States Patent
Turover et al.

(10) Patent No.: US 10,131,066 B2
(45) Date of Patent: Nov. 20, 2018

(54) CUTTING APPARATUS, SYSTEM AND METHOD

(71) Applicant: Crave Products, Inc., Palatine, IL (US)

(72) Inventors: David Turover, Chicago, IL (US); Craig Wenger, Chicago, IL (US)

(73) Assignee: Crave Products, Inc., Palatine, IL (US)

( * ) Notice: Subject to any disclaimer, the term of this patent is extended or adjusted under 35 U.S.C. 154(b) by 283 days.

(21) Appl. No.: 15/014,632

(22) Filed: Feb. 3, 2016

(65) Prior Publication Data

US 2017/0217036 A1 Aug. 3, 2017

(51) Int. Cl.
*B26B 29/06* (2006.01)

(52) U.S. Cl.
CPC ..... *B26B 29/063* (2013.01)

(58) Field of Classification Search
CPC ..... B26B 29/063; B26B 27/002; A47J 25/00; A47J 17/04; B26D 3/26; B26D 7/2614; B26D 3/24; A21C 15/04
USPC ..... 83/13; 30/302, 123.6, 114, 123.5, 123.7, 30/299, 337, 124, 296.1; 99/537, 541, 99/584, 506, 509, 544, 554, 540; D7/672–676
See application file for complete search history.

(56) References Cited

U.S. PATENT DOCUMENTS 1,703,154 A 2/1929 Lanzkorn
1,764,235 A 6/1930 Wilmking
2,089,980 A 8/1937 Owen
2,108,992 A 2/1938 Obenshain
2,166,624 A * 7/1939 Cohn ..... B26D 1/553 83/466.1
2,487,234 A 11/1948 Gore
3,075,565 A 1/1963 Weaver et al.
3,132,678 A 5/1964 Steketee
3,292,257 A * 12/1966 Popeil ..... A23N 15/04 30/121.5
3,452,795 A 7/1969 Davies
4,165,855 A * 8/1979 Mason, Jr. ..... A47G 19/00 249/102
4,580,343 A 4/1986 Bell, Jr.
4,730,395 A * 3/1988 Blessing, Sr. ..... B23B 51/0426 30/360
D298,199 S * 10/1988 Finsilver ..... D7/538
4,948,106 A 8/1990 Popeil et al.
4,959,903 A * 10/1990 Daoust ..... A47J 17/04 30/114
D335,795 S * 5/1993 Conti ..... D7/359
5,499,578 A 3/1996 Payne
5,937,525 A * 8/1999 Chan ..... A47J 25/00 30/114
8,272,631 B2 9/2012 Gannon
(Continued)

*Primary Examiner* — Ghassem Alie
(74) *Attorney, Agent, or Firm* — Scherrer Patent & Trademark Law, P.C.; Stephen T. Scherrer; Monique A. Morneault

(57) ABSTRACT

An improved apparatus, system and method for preparing food items, is described. Specifically, the present disclosure is directed to an improved cutting apparatus for cutting and slicing food items. The cutting apparatus includes modular components that provide containment space for the food items, as well as cutting surfaces for receiving, cutting and slicing the food items. The present cutting apparatus provides an efficient, step-saving system and method for cutting, slicing, mixing and preparing food items.

13 Claims, 13 Drawing Sheets

(56) References Cited

U.S. PATENT DOCUMENTS

| | | | | |
|---|---|---|---|---|
| 8,448,552 | B2 | 5/2013 | Hoffman | |
| 9,259,847 | B2 * | 2/2016 | White, III | B26D 3/24 |
| D769,054 | S * | 10/2016 | Lee | D7/352 |
| D776,500 | S * | 1/2017 | Verbrugge | D7/693 |
| 2004/0016131 | A1 | 1/2004 | Hayashi | |
| 2008/0168660 | A1 * | 7/2008 | Chiu | A47J 19/02 30/114 |
| 2009/0282990 | A1 * | 11/2009 | Farnum | B26B 3/04 99/537 |

* cited by examiner

CUTTING APPARATUS, SYSTEM AND METHOD

TECHNICAL FIELD

The present invention relates to cutting apparatuses, systems and methods for slicing, cutting and combining food items. In particular, the present disclosure relates to a cutting apparatus having interlocking, modular components that combine to form a self-contained unit for receiving, cutting and slicing food items, without the need for special knife skills. A system and method for cutting food items requiring fewer preparation steps is also provided.

BACKGROUND

It is, of course, generally known to cut up food items, such as vegetables, fruits and meats using a knife. In order to cut vegetables, meats and other items into smaller pieces, it is necessary to put the knife in several cross directions, which can require some degree of knife skills for even cutting and slicing. Additionally, as the items get smaller during cutting, it can become more difficult to hold the items by hand in order to complete the cutting process, which may lead to inadvertent injury.

Cutting and slicing food items can also be tedious. Some items, such as onions, tend to be difficult to cut not only because of their layers, but also because of the chemical that is released during cutting, which is irritating to the eyes. Other items, such as tomatoes, peaches, nectarines can be soft and difficult to cut into uniform pieces. Finally, certain types of fruit, such as apples and oranges can likewise be difficult to cut into uniform pieces.

Preparing a salad typically includes cutting lettuce and other vegetables into bite size pieces using a cutting board. The cut items are then typically combined into a separate container for mixing and serving. It would be advantageous to combine the steps of making a salad, including cutting the vegetables and combining them into a serving bowl, in fewer steps.

Therefore, it would be advantageous to provide a cutting apparatus, system and method that provides a modular unit that combines cutting, serving and storage of the cut food items.

It would be further advantageous to provide a cutting apparatus, system and method for cutting and combining food items having a combination of components that are easily nested together for use and storage.

It would also be advantageous to provide a cutting apparatus, system and method for cutting and/or slicing food items without requiring the user to directly handle the food item while it is being cut.

Additionally, it would be advantageous to provide a cutting apparatus, system and method for cutting and slicing food items into uniform pieces without requiring special knife skills.

It would be further advantageous to provide a cutting apparatus, system and method for cutting and slicing food items without the need to place hands and fingers in proximity of the cutting blades.

It would be advantageous to provide a cutting apparatus, system and method that saves process steps during food preparation.

It would be advantageous to provide a cutting apparatus, system and method that allows for the cutting and slicing of foods, retaining water, fluids and/or juices that are normally lost during the cutting process, providing for healthier and tastier foods.

It would be further advantageous to provide a cutting apparatus, system and method that allows the cutting and slicing of food allowing for easy rotation of the cutting surface. Moreover, it would be advantageous to provide a cutting apparatus, system and method that allows a cutting template to be disposed over the food items to be cut, and by rotation of the cutting surface provides for alternate positioning of the food items on the cutting surface and beneath the cutting template. Further, it would be advantageous to provide a cutting apparatus, system and method that provides a raised cutting surface, such that when a cutting template is placed over the food items to be cut, and the cutting surface is rotated therebeneath, the food items remain on the cutting surface without being subject to falling out of the apparatus.

These and other aspects of the invention will become readily apparent from the detailed description, which follows.

SUMMARY

The present disclosure relates to an improved apparatus, system and method for preparing food items. Specifically, the present disclosure is directed to an improved cutting apparatus for cutting and slicing food items. The cutting apparatus includes modular components that provide containment space for the food items, as well as cutting surfaces for receiving, cutting and slicing the food items. Additionally, the present cutting apparatus can serve as a mixing and serving device. Thus, the present cutting apparatus provides an efficient, step-saving system and method for cutting, slicing, mixing and preparing food items.

To this end, in an embodiment of the present invention, a cutting apparatus is described. The cutting apparatus comprises a first cutting body having a bowl shape and an outer rim, wherein a circumference of the rim forms a wave pattern, a plurality of slots passing through the first cutting body, and a base releasably attached to the outer rim of the first cutting body, wherein the base is a cutting surface.

In another embodiment, a device for receiving, cutting, mixing, and storing food items is described. The device comprises a first cutting body having a generally semispherical shape forming an inner space and an outer rim having a wave pattern, a plurality of parallel slots covering an outer surface of the first cutting body, wherein the slots connect the outer surface of the body with the inner space, a base having a platform for receiving an item to be cut, wherein the first cutting body is releasably secured to the base, a second cutting body having a generally semispherical shape disposed within the inner space of the first cutting body, the second cutting body releaseably secured to the base platform, a plurality of radially arranged slots intersecting at a top surface of the second cutting body, and, an outer body having a generally semispherical shape forming an inner space for receiving the first cutting body and second cutting body.

In yet another embodiment, a system for cutting food items is described. The system comprises a first cutting body having a bowl shape forming a semispherical inner space for receiving an item for cutting and a rim having a circumferential wave pattern, a plurality of slots disposed on the first cutting body wherein the slots connect an outer surface of the body with the inner, wherein the slots are adapted for receiving a cutting device, and, a base releasably attached to the rim of the first cutting body, wherein the base further includes a platform for receiving an item to be cut and acts as a cutting surface.

In yet a further embodiment, a method for cutting and processing food items is disclosed. The method comprises the steps of providing a first cutting body having a semi-spherical inner space for receiving an item for cutting and a rim having a first wave pattern, wherein the body includes a plurality of slots passing through the first cutting body and connecting an outer surface of the body with the inner space, providing a base with a platform having an outer circumference including a second wave pattern, receiving an item to be cut on the platform, engaging the first wave pattern on the rim with the second wave pattern on the platform thereby securing the first cutting body to the base, passing a cutting device through the plurality of slots, and, cutting the item on the platform.

It is, therefore, an advantage and objective of the present disclosure to provide a cutting apparatus, system and method for preparing food items requiring fewer process steps.

Moreover, it is an advantage and objective of the present disclosure to provide a cutting apparatus, system and method for cutting and slicing food items into multiple uniform pieces without requiring special knife skills.

It is further an advantage and objective of the present disclosure to provide a cutting apparatus which creates a barrier between the fingers/hands of the user and the knife or cutting implement, as well as, the food items being cut.

Moreover, it is an advantage and objective of the present disclosure to provide a cutting apparatus, system and method that allows for the cutting and slicing of foods, retaining water, fluids and/or juices that are normally lost during the cutting process, providing for healthier and tastier foods.

It is a further advantage and objective of the present disclosure to provide a cutting apparatus, system and method that allows the cutting and slicing of food allowing for easy rotation of the cutting surface.

Moreover, it is a further advantage and objective of the present disclosure to provide a cutting apparatus, system and method that allows a cutting template to be disposed over the food items to be cut, and by rotation of the cutting surface provides for alternate positioning of the food items on the cutting surface and beneath the cutting template.

Further, it is an advantage and objective of the present disclosure to provide a cutting apparatus, system and method that provides a raised cutting surface, such that when a cutting template is placed over the food items to be cut, and the cutting surface is rotated therebeneath, the food items remain on the cutting surface without being subject to falling out of the apparatus.

Additional features and advantages of the present disclosure are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

Figure 1:
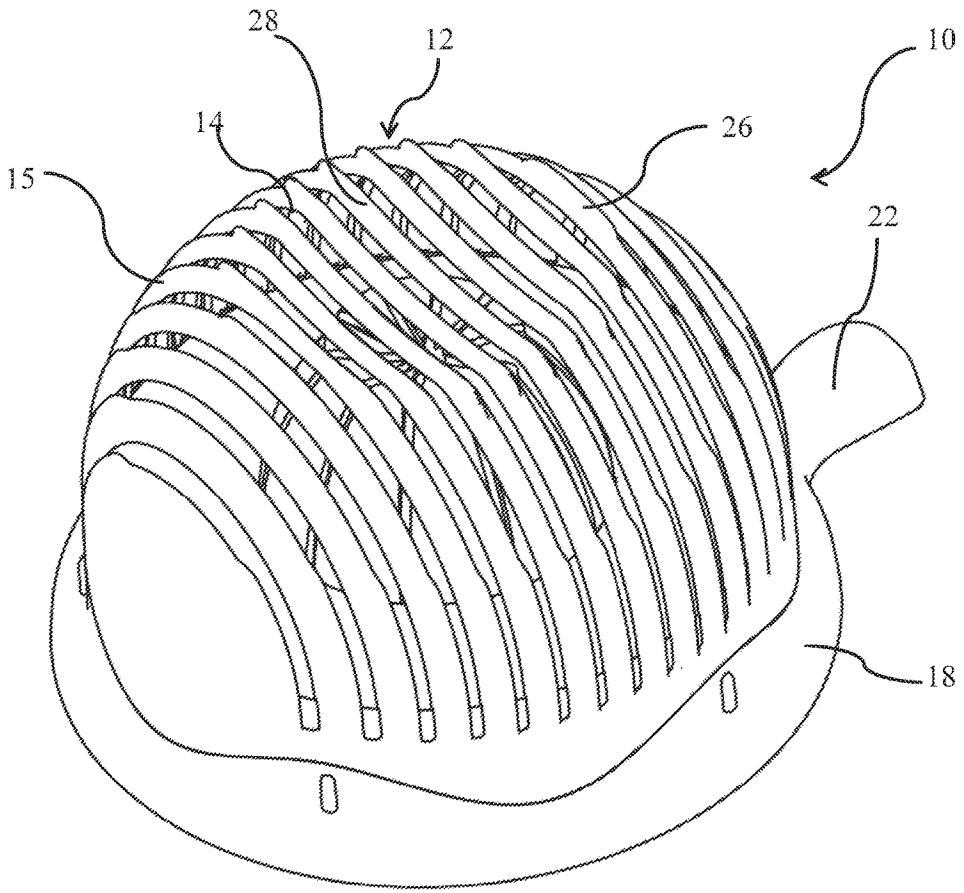
FIG. 1 illustrates a perspective view of a cutting apparatus of the present disclosure.

The present invention relates to a cutting apparatus. More specifically, the present disclosure relates to a cutting apparatus having interlocking, modular components that combine to form a self-contained unit for receiving, cutting and slicing food items. Systems and methods for using the cutting apparatus are also provided.

Now referring to the figures, wherein like numerals refer to like parts, FIGS. 1-13 show several embodiments and components of the present cutting apparatus 10. FIGS. 1-4 illustrate an initial embodiment of the present cutting apparatus 10. The cutting apparatus 10 includes a first cutting body 12 having a semispherical or bowl shape. The first cutting body 12 further includes a plurality of slots 14 that receive and guide a cutting implement (not shown), which may have one blade or multiple blades on a single handle. The first cutting body 12 may have a plurality of ribs 15 between the plurality of slots 14 and dividing the plurality of slots from one another. The cutting apparatus 10 may also include a second cutting body 16, which can be sized so it is contained within the first cutting body 12, particularly when the apparatus is in a stored position. The second cutting body 16 also includes a plurality of slots. The first and second cutting bodies 12, 16 are used to cover the food items to be cut. The cutting apparatus further includes a base 18 having a platform 19 for engagement with the cutting bodies, and a cover 20.

Figure 2:
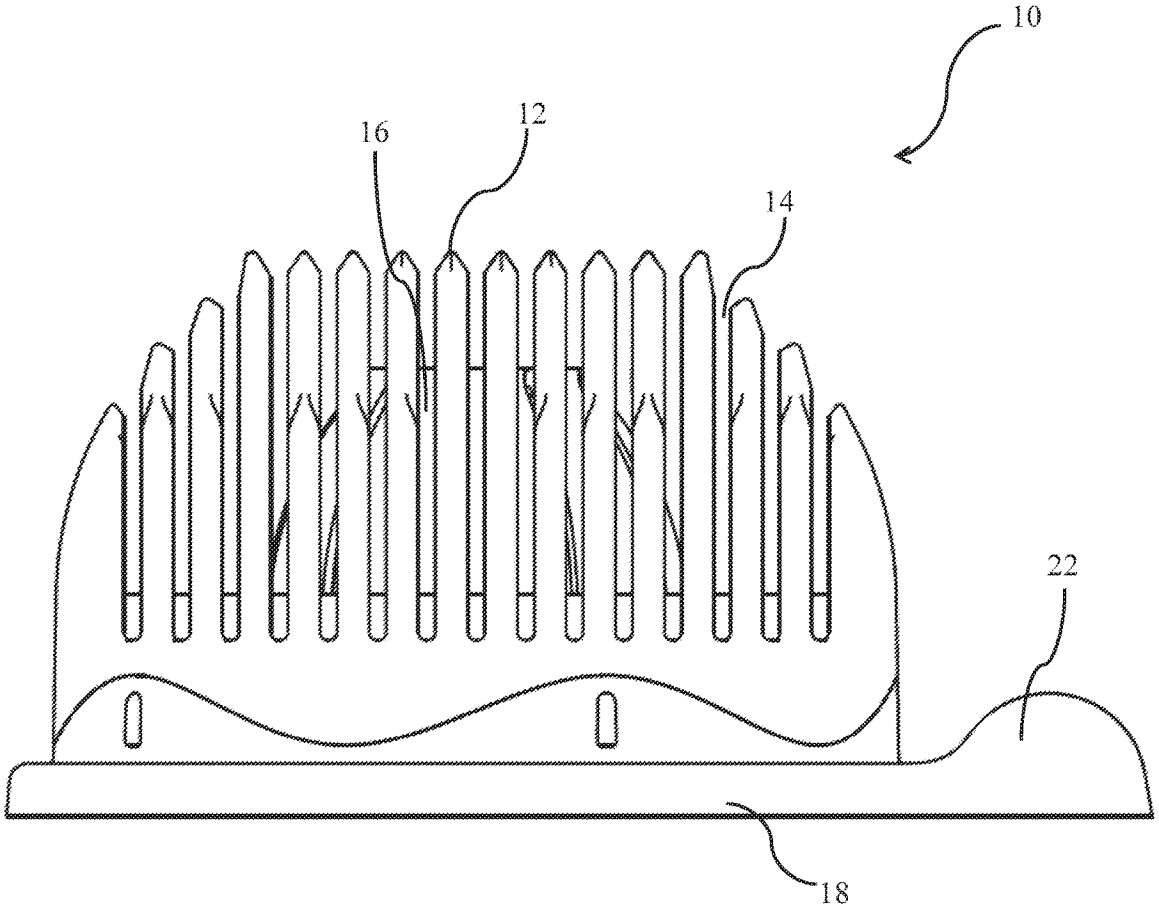
FIG. 2 illustrates a side view of the cutting apparatus of the present disclosure.
Figure 3:
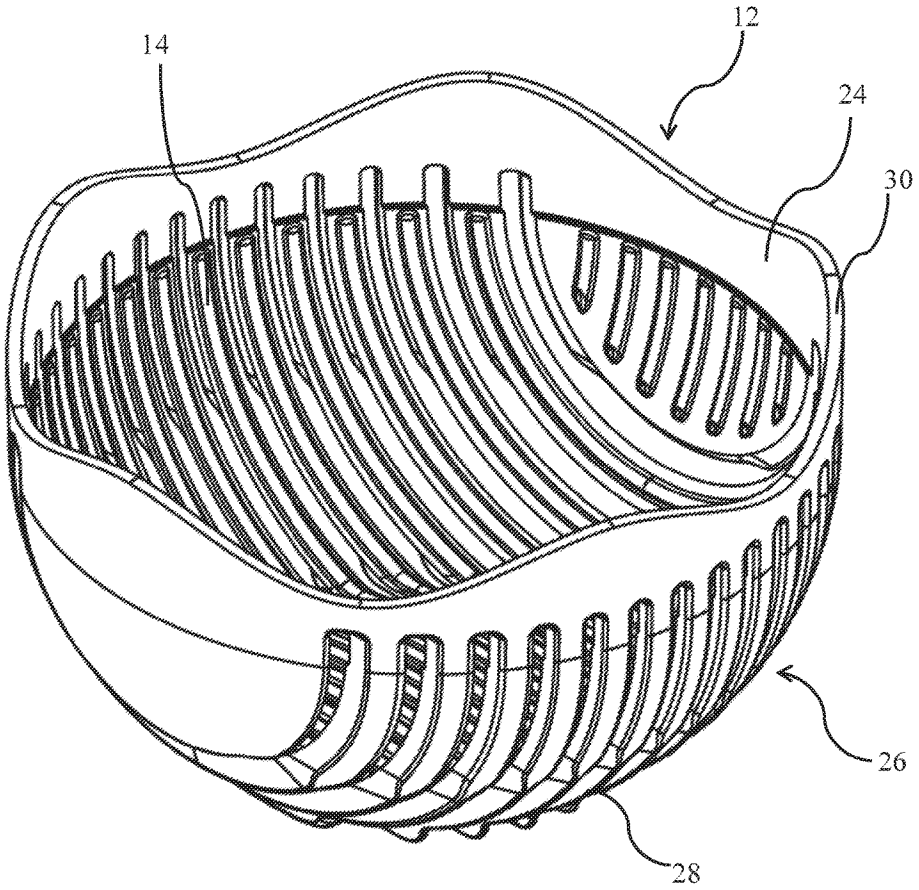
FIG. 3 illustrates a perspective view of a first cutting body of the cutting apparatus of the present disclosure.

Referring to FIG. 3, the first cutting body 12 is shown having a semispherical or dome-like shape, which forms an open inner space 24. An outer surface 26 of the first cutting body 12 further includes a flattened section 28 of any suitable shape or diameter, which is also clearly seen in FIGS. 1 and 2. When the first cutting body 12 is turned over to rest on the flattened section 28 as shown in FIG. 3, the body is prevented from rolling and can be used as a receiving and serving bowl. It should be understood that the first cutting body 12 can have any suitable shape, including round, oval, even square or rectangular.

The first cutting body 12 includes an opening rim 30 forming the outer circumference of the body. As shown in FIG. 3, the outer circumference of the rim 30 has an uneven or wave pattern, so that if the body 12 was placed rim side on a flat surface, the shape of the rim would not permit the body to lay flat. The wave pattern of the rim 30 provides a unique shape that permits the first cutting body 12 to engage with and be secured to the base 18. Multiple variations of wave patterns or various wave lengths are useful in the different embodiments of the present apparatus. For example, the platform 19 of FIG. 1 has a wave pattern 19*d* with a longer wave length (the distance between the crest of the wave and the trough of the wave), while the platform 50 having the wave pattern 50*a* of the embodiment of the cutting apparatus 100 illustrated in FIG. 12, has a shorter wave length.

Figure 4:
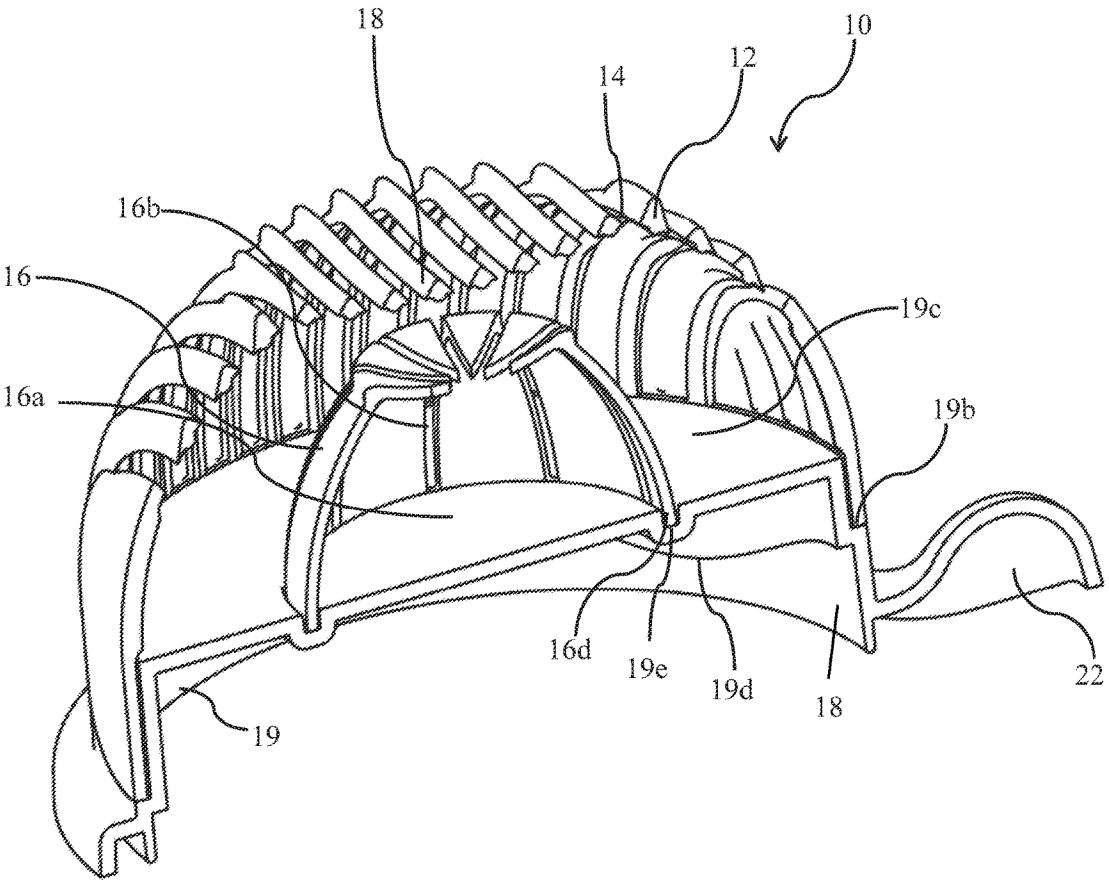
FIG. 4 illustrates a cut-away view of the cutting apparatus of the present disclosure.

Referring to FIGS. 2 and 4, the apparatus 10 includes a base 18 with a platform 19. The platform 19 is adapted for receiving and securing both the first cutting body 12 and the second cutting body 16. The base 18 is shaped in a configuration to complement the overall shape of the first cutting body 12, whether the cutting body is round, oval, rectangular, or another suitable shape.

The base 18 further includes a handle 22. The handle 22, which is integrally formed with the base, is shown having a semi-circular profile. The shape of the handle 22 complements the overall shape of the apparatus 10 and makes the handle easier to grasp; however, it should be understood that the handle can have any suitable shape.

As shown in FIGS. 2 and 4, the base 18 includes an integrated raised platform 19. The platform 19 has a step configuration, with a first level 19*a* for receiving the cover 20, a second level 19*b* for receiving the first cutting body 12, and a third level 19*c* forming a cutting surface. As shown in FIG. 3, the rim of the cover 20 rests against the first level 19*a* of the platform and on the base 18, whereas, the first cutting body 12 rests on and against the second level 19*b* of the platform. Additionally, the second level 19*b* has a wave pattern 19*d* forming an outer circumference of the platform 19. Thus, the wave patterned rim 30 of the first cutting body 12 engages with the wave pattern 19*d* forming the outer circumference of the platform thereby securing the first cutting body 12 to the platform 19 and the base 18. The platform 19 additionally serves as a receiving and cutting surface (third level 19*c*) for the items placed within the first cutting body 12. Preferably, the platform 19 is disposed above the wave pattern 19*d* formed on the outer circumference of the platform 19.

As shown in the figures, the first cutting body 12 further includes a plurality of slots 14. The slots 14 are provided over the entire body and are generally evenly spaced (approximately 3.5 mm apart) from one another and positioned parallel to one another, passing through and covering the entire outer surface 26 of the first cutting body 12 from one side of the rim 30 to the other. The slots 14 can have any suitable width for receiving a cutting implement. The slots 14 are used for receiving and guiding a cutting implement, such as a knife blade to enter the inner space 24 of the first cutting body 12 for cutting the food item held within the cutting body. It should be understood that the overall dimension of the first cutting body, the width of the slots, and the distance between the slots are not limited to the present embodiment, but can be altered to accommodate different cutting implements, as well as the food items to be processed.

Figure 13:
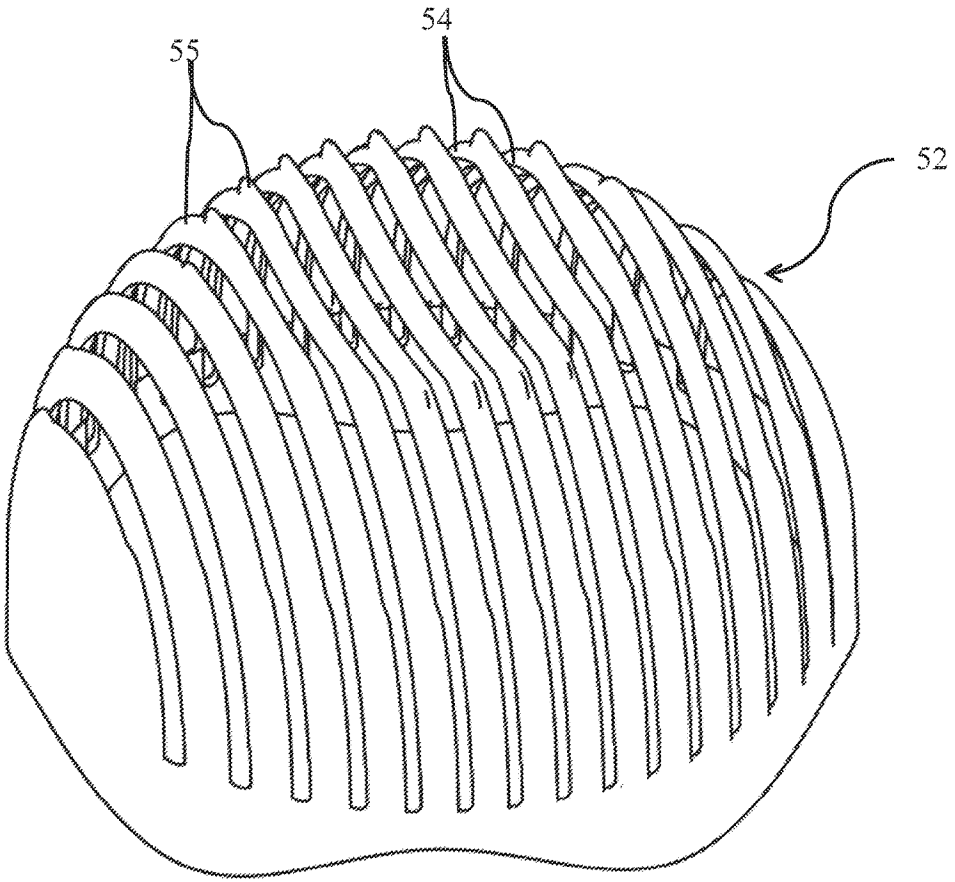
FIG. 13 illustrates a perspective view of a first cutting body in an alternate embodiment of the present disclosure.

In an alternate embodiment of the present invention, FIG. 13 illustrates a first cutting body 52 having a plurality of evenly spaced, parallel slots 54 therein, in a similar configuration to the first cutting body 12, disclosed above. The ribs 55 may be between the plurality of slots 54 and divide the plurality of slots 54 from each other. As illustrated in FIGS. 1-4, the plurality of ribs 15 may be flat. However, each of the plurality of ribs 55 may come together at a midpoint thereof in a peak or a point, having angled sides disposed downwardly to help guide a cutting implement to the food item contained therein without having to take time and effort to align the cutting implement with the slots 5. Moreover, the ribs 55, as shown in FIG. 13 and described above, may further help ensure that the cutting implement easily moves into one or more of the slots 54, preventing the cutting implement from slipping left or right, possibly causing injury. In other words, a user may place a cutting implement in alignment with one or more of the slots 54, and the peaked and angled ribs may guide the blade of the cutting implement to the food item contained therein.

In use, a food item may be placed on the third level 19*c* of the platform 19 of the base 18. The first cutting body 12 (or 52, as shown in FIG. 13) may be positioned on the platform 19 of the base 18, resting on the second level 19*b* thereof, having the wave pattern thereon. A cutting implement, such as a knife having a suitable blade length, may be disposed through one or more of the slots 14 (or 54) to cut the food item therein. Thus, the food item may be cut into two or more portions. Optionally, the handle 22 may be grasped by the user and the base 18 may be rotated, while the first cutting body may be held in place, thereby rotating the food item contained on the base 18. The cutting implement may be used to cut the food item one or more additional times through the slots 14 (or 54), but because the food item has been rotated, the cuts placed into the food items are cross-cuts to the cuts placed into the food item prior to rotation. The base 18 may be rotated a plurality of times to place several cross-cuts into the food items contained therein. This may be particularly preferable when cutting ingredients for a salad to create a chopped salad, for example. The wave pattern in the second level 19*b* may provide discrete positions for the first cutting body 12 to be placed for cutting of the food contained therein. Further, as illustrated in FIG. 3, the first cutting body 12 (or 52) may be inverted to be used as a bowl to contain the cut food item or items. Preferably, the second level 19*b* may be positioned above the wave pattern 19*d* such that an item placed and cut on the second level 19*b* may remain entirely contained within the cutting body 12 when the platform 19 and base 18 rotates therebeneath.

Figure 5:
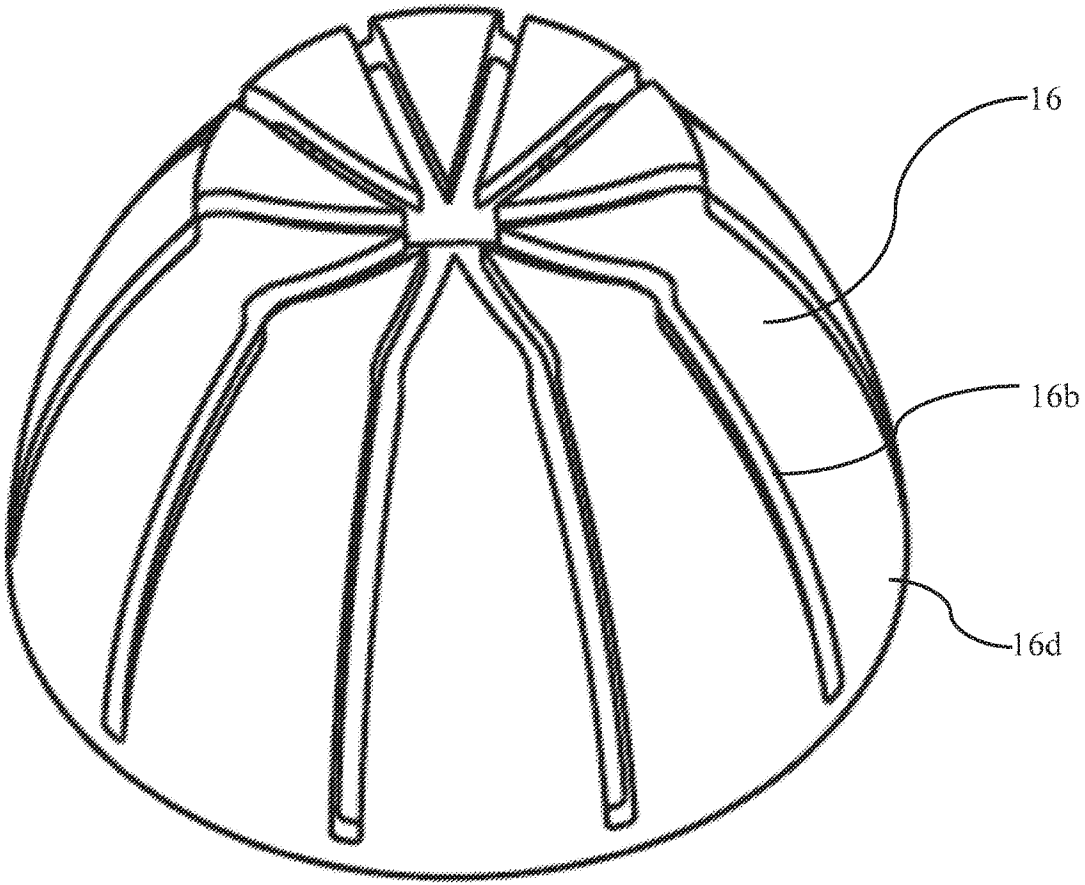
FIG. 5 illustrates a perspective view of a second cutting body of the cutting apparatus of the present disclosure.

Referring to FIG. 5, the cutting apparatus 10 includes a second cutting body 16. The second cutting body 16 is generally smaller in size than the first cutting body 12, so that the second cutting body can be positioned within the inner space 24 of the first cutting body, providing a compact arrangement particularly when storing the cutting apparatus 10. The second cutting body 16 has a semispherical outer surface forming an inner space 16*a* for receiving an item to be cut (FIG. 4).

The second cutter body 16 also includes a plurality of radially arranged slots 16*b* intersecting and forming a top opening 16*c* of the second cutting body. The slots 16*b* and top opening 16*c* of the second body 16 receive and guide a knife blade into the inner space 16*a* of the body for contacting a food item held within the inner space 16*a* of the body. The second cutting body 16 is useful for cutting food items into uniform wedges. Thus, the second cutting body 16 is useful for cutting and slicing smaller items, including tomatoes, oranges, peaches, and onions, just to name a few.

Referring to FIG. 4, the second cutting body 16 is adapted for engagement with the platform 19, so that the cutting body remains stable during use. For example, the platform 19 may include a channel 19*e* on the third or top level surface 19*c* of the platform. The channel 19*e* has a width complimentary to the width of the outer rim 16*d* of the cutting body 16. The outer rim 16*d* may be snap fit into the channel 19*e* of the platform, securing the cutting body into place over the food item to be cut.

Figure 6:
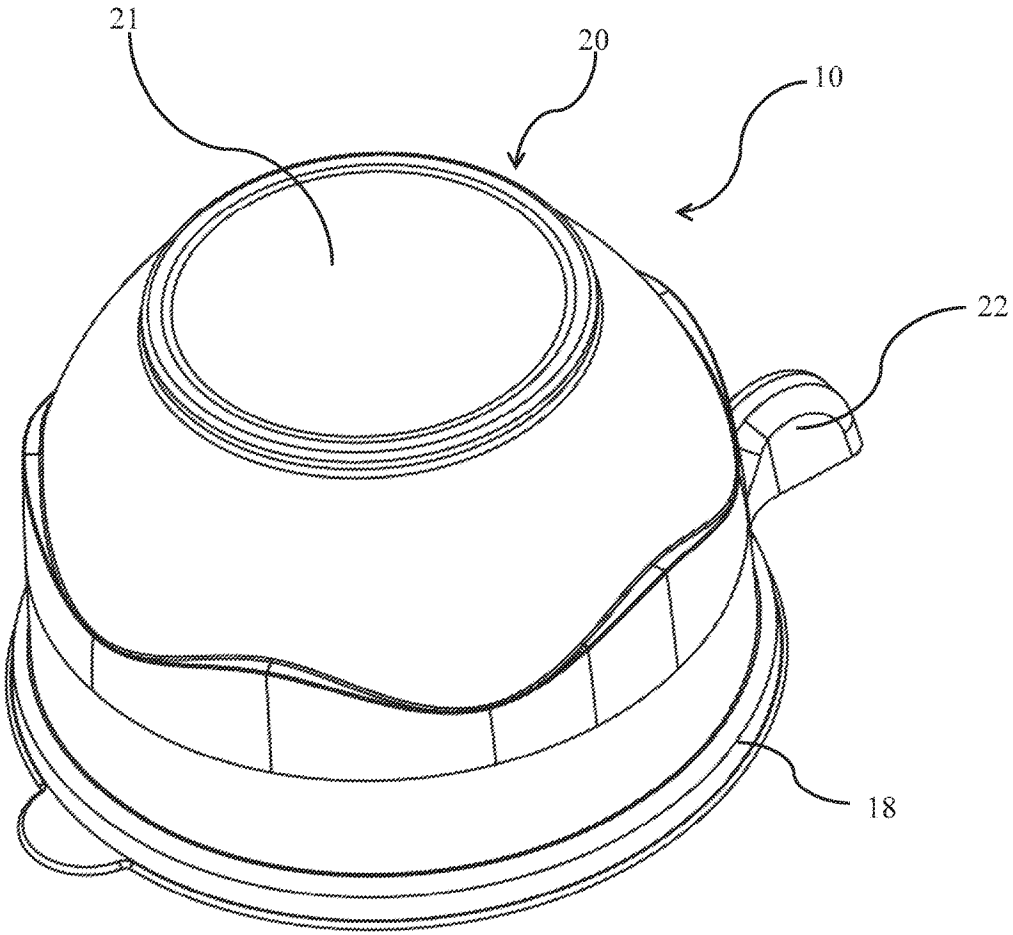
FIG. 6 illustrates a perspective view of a cover on the cutting apparatus of the present disclosure.

Referring to FIG. 6, a cover 20 is adapted for placement over the first cutting body 12. As shown, the cover 20 has a semispherical or bowl shape, which complements the cutting bodies previously described. Additionally, the cover 20 includes a flattened section 21, so that if the cover is turned over onto the flattened section, the cover is stable and will be prevented from rolling. The cover 20 may be inverted, with the opening on the top thereof, and used as a bowl. In addition, the first cutting body 12 may be placed with its opening at the top thereof in face-to-face relation to the cover 20 to form a spherical body (not shown) that may contain cut food items therein for shaking and blending of the food items, such as to make a chopped salad, or other like food blend.

Figure 7:
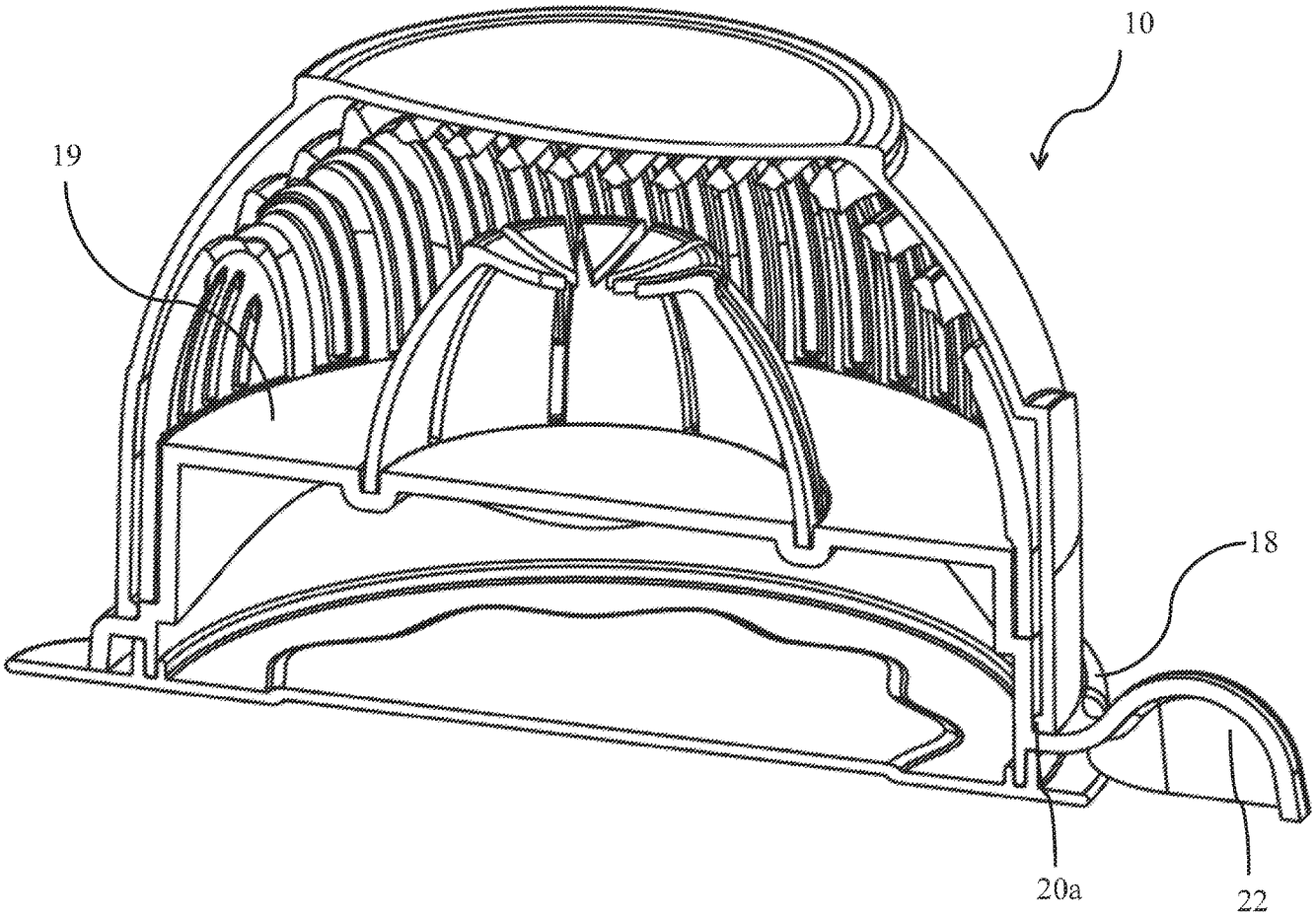
FIG. 7 illustrates a second cut-away view of the cutting apparatus of the present disclosure.
Figure 8:
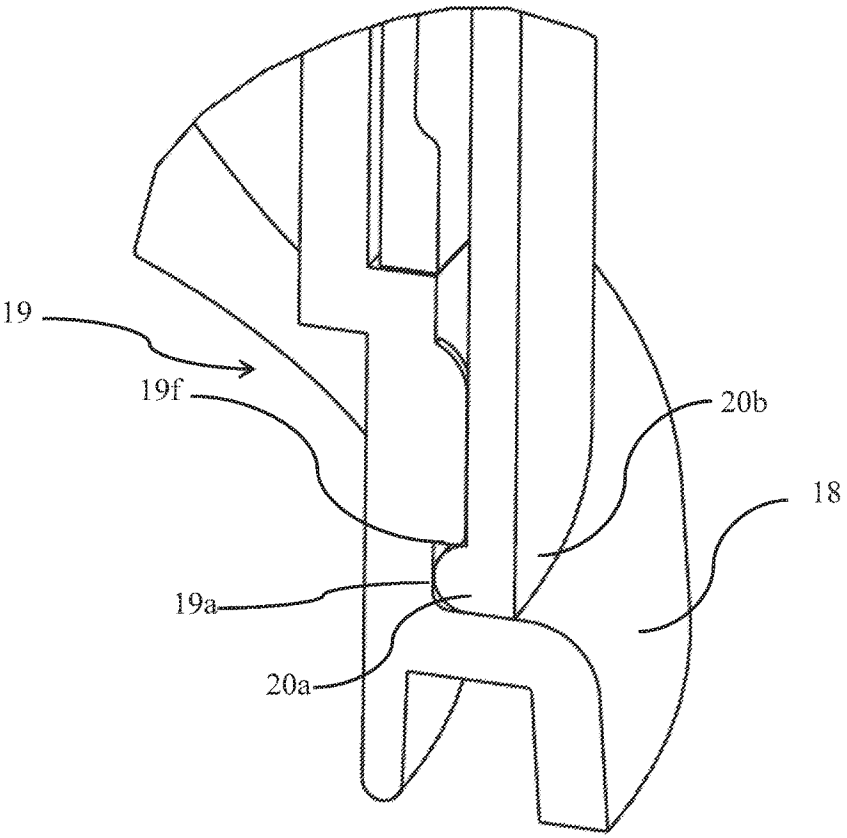
FIG. 8 illustrates a close-up cut-away view of an engagement element for the cover of the cutting apparatus of the present disclosure.

Referring to FIGS. 7 and 8, there is shown the cover 20 engaged in a closed position with the base 18 and platform 19. Specifically, as shown in detail in FIG. 8, the cover 20 includes a lip 20*a* around the outer circumference of the rim 20*b* of the cover. The lip 20*a* engages in a snap-fit configuration with a ledge 19*f* on the first level 19*a* of the platform. In this manner, the cover 20 can be secured to the base 18 and its platform 19, thereby enclosing all of the components of the apparatus 10 for transportation and storage.

Figure 9:
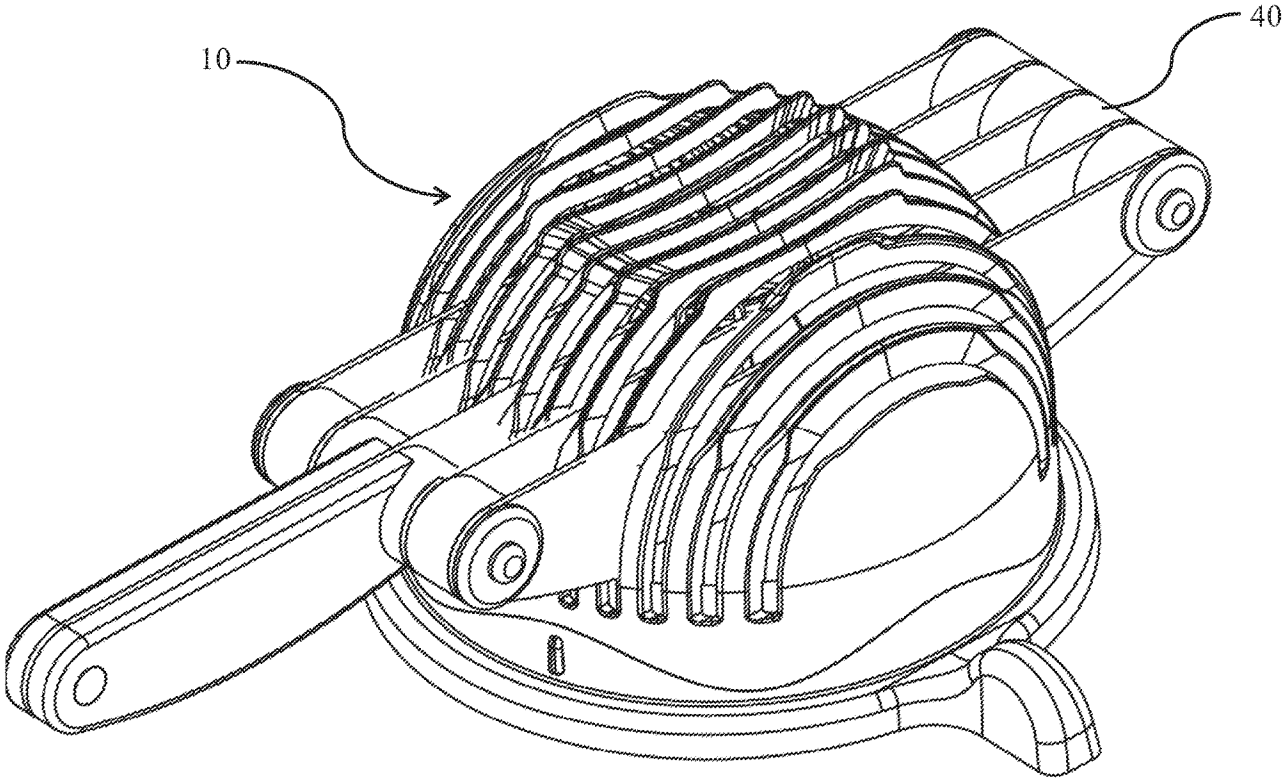
FIG. 9 illustrates a perspective view of the cutting apparatus of the present disclosure in use with a cutting implement.
Figure 10:
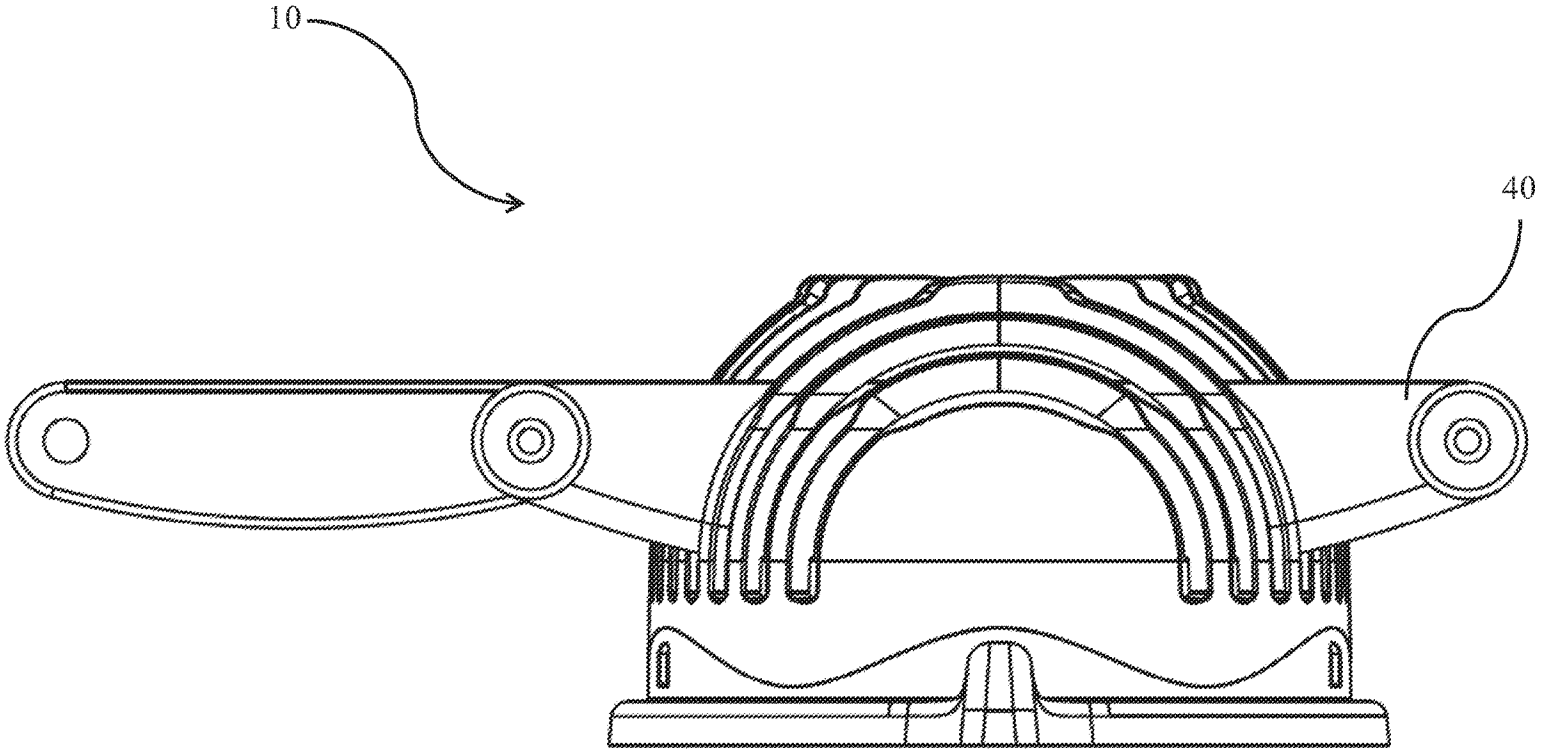
FIG. 10 illustrates a side view of the cutting apparatus of the present disclosure in use with a cutting implement.
Figure 11:
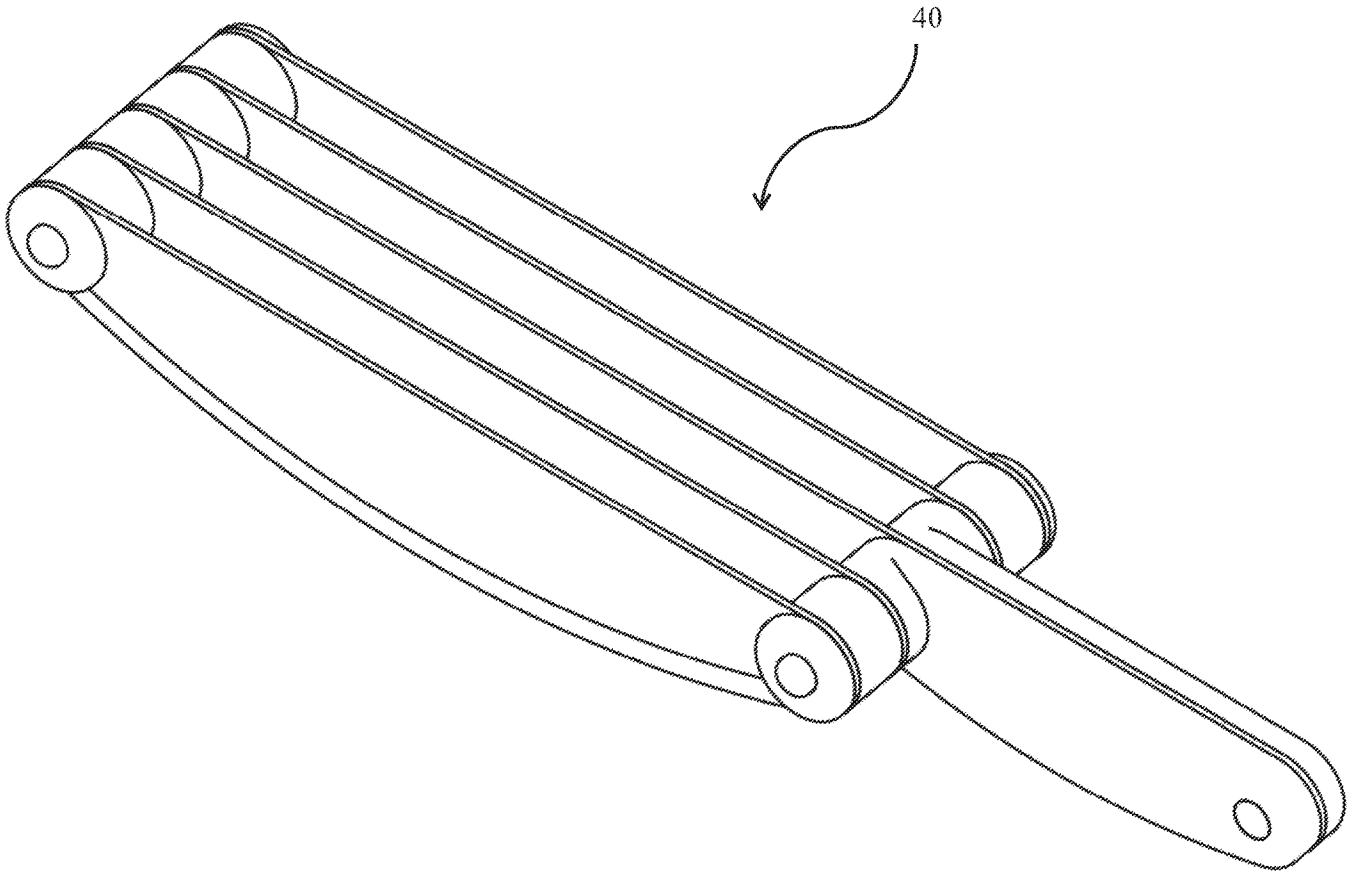
FIG. 11 illustrates a perspective view of a cutting implement useful with the cutting apparatus of the present disclosure; and, FIG. 12 illustrates another embodiment of a perspective view of a cutting apparatus of the present disclosure.

Referring now to FIGS. 9-11, there is shown the present apparatus 10 in use with a cutting implement, and specifically a multi-bladed knife 40. It should be understood that the present apparatus 10 is suitable for receiving a standard, single bladed knife, as the slots provided in both the first cutting body 12 and second cutting body 16 are capable of receiving a standard knife blade. However, the present multi-bladed knife 40, when used with the embodiment of the present cutting apparatus 10, provides a system that saves considerable time in the food preparation process. Cutting and slicing food items, such as vegetables, for use in a salad or other dishes can require a certain amount of knife skills, and often be the most tedious chore in food preparation. Using the multi-bladed 40 knife with the present cutting apparatus makes this step in the preparation much quicker and easier as the system simultaneously creates multiple cuts with a single swipe of the blades through the slots of the apparatus.

Although the multi-bladed knife 40 is illustrated with five blades, it should be understood that the multi-bladed knife 40 may have any number of blades for aiding a user in easily and quickly cutting a food item therein, and should not be limited as described herein. The blades of the multi-bladed knife 40 are generally spaced apart in parallel relation from each other to align with a plurality of the parallel slots 14 within the first cutting body 12. The blades may be aligned with adjacent slots 14 of the first cutting body 12, or non-adjacent slots. For example, adjacent blades of the multi-bladed knife 40 may align with non-adjacent slots, such as skipping one or more slots. Thus, the multi-bladed knife 40 may be used to provide relatively thick slices of food products, although thinner food slices may also be accomplished by moving the multi-bladed knife 40 into different non-adjacent slots within the first cutting body 12.

Figure 12:
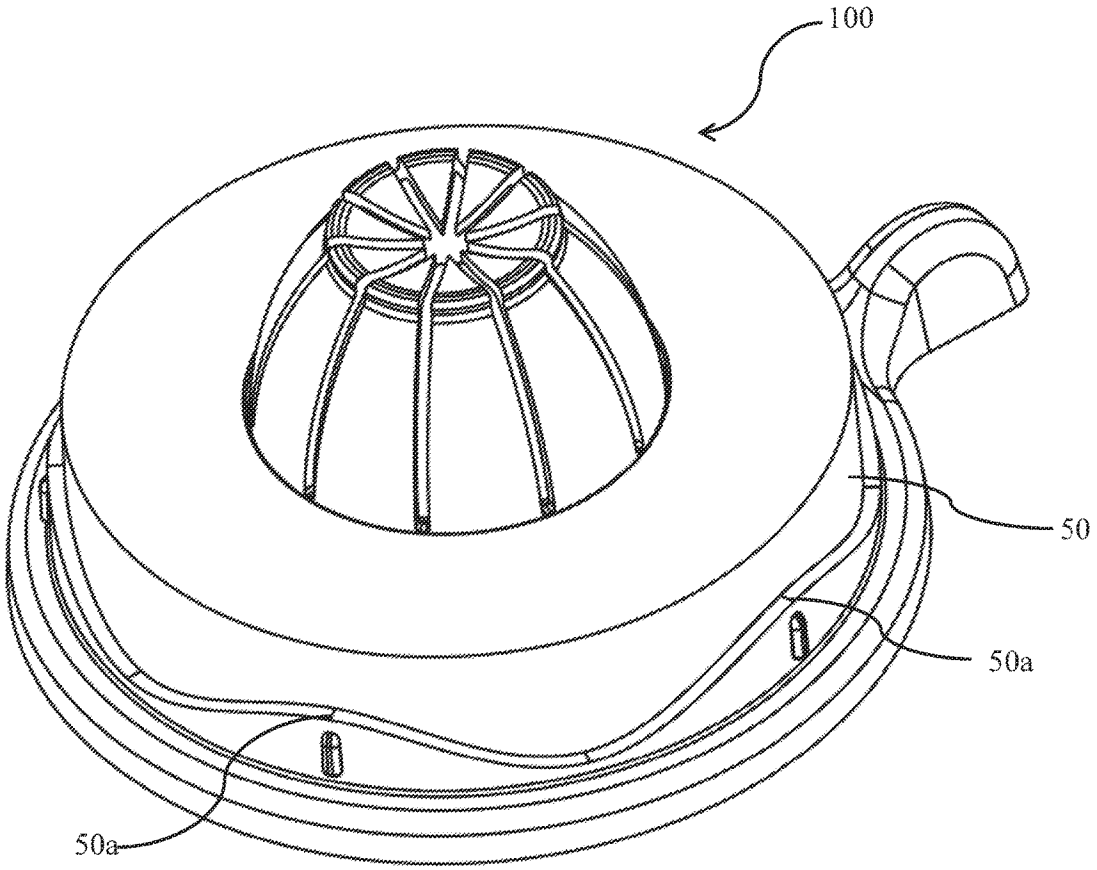

FIG. 12 represents yet another embodiment of the present cutting apparatus 100. In this embodiment, the platform 50 includes a wave pattern 50*a* having a shorter wave length than that of the previous embodiment. Although not shown, it is understood that this wave pattern 50*a* would engage with and first cutting body having a complementary wave pattern, as previously described.

Using the present cutting apparatus 10 in a method for cutting and processing food items begins with placing the food items to be processed on the platform 19, specifically the third or top level 19*c* of the platform. If the first cutting body 12 is being used, the outer wave pattern rim 30 of the body is aligned with the corresponding wave pattern 19*d* on the second level 19*b* of the platform 19. Once the first cutting body 12 is engaged with the platform 19, the multi-bladed knife 40 is passed through the slots 14 in a first direction, to initially cut the food items (FIGS. 7 and 8). Taking the handle 22 of the base 18, and while lifting the first cutting body 12 slightly away from the platform to disengage the rim 30 from the platform 19*b* the base 18 and platform 19 are rotated by grasping the handle 22. The wave pattern on the rim 30 of the body 12 is then aligned again with the next wave pattern 19*d* on the platform. The multi-bladed knife 40 (or single blade knife, if being used), is again passed through the slots 14 and into the food item for further cutting or slicing. These steps, rotation of the platform 19 and alignment with the cutting body 12, are repeated until the food item is sliced or cut to the desired consistency.

A similar approach is used when the second cutting body 16 is used. The food item is placed on the platform 19 and the second cutting body is snap-fit into the channel 19*e* on the top level 19*c* of the platform, to cover the food item. However, rather than the multi-bladed knife, a standard single blade knife (not shown) is passed repeatedly though the slots 16*b* of the second cutting body 16, until the item is cut into uniform wedges. The cut food item could then be removed, along with the second cutting body 16 prior attaching the first cutting body 12, or the food items may remain on the platform 19 for additional processing when the first cutting body is secured to the base 18.

Certainly, the present cutting apparatus 10 provides several options with regard to processing, cutting and slicing food items. Additionally, the modular fit of the components of the apparatus 10 gives the users various cutting options, as well as, the option to mix the final cut or sliced food products together within the apparatus. The plurality of slots within the first and second cutting bodies provide the advantage of simultaneously cutting food items into multiple pieces, saving time in the overall process. Furthermore, use of the cutting bodies act as a shield between the food items being cut, the cutting implements and the fingers and hands of the user. The cutting bodies, platform, base and cover can be constructed from any material that is easily cleaned and suitable for use with food, including silicone and plastic.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

We claim:

1. A cutting apparatus comprising:

a first cutting body having a surface forming a dome shape and an outer rim, wherein a circumference of the outer rim forms a first sinusoidal wave pattern, wherein the first wave pattern is configured to have an amplitude running vertically within the outer rim when the outer rim is placed on a horizontal surface;

a plurality of parallel slots passing through the surface of the dome of the first cutting body; and, a base having a first surface forming a second sinusoidal wave pattern, wherein the second wave pattern is configured to have an amplitude running vertically within the base when the base is disposed on a horizontal surface and configured to contact and fit within the first wave pattern of the circumference of the outer rim of the first cutting body when the first cutting body is disposed on the base in a dome configuration, wherein the base further comprises a second surface configured to be a horizontal cutting surface for a food item placed thereon and under the first cutting body when the base is placed on a horizontal surface, wherein each of the plurality of slots adapted to receive and guide a cutting device therethrough to cut the food item placed on the second surface.

2. The cutting apparatus of claim 1, wherein the first cutting body comprises a plurality of ribs, each rib disposed between two of the plurality of slots, wherein each rib comprises a peak and angled sides and are adapted to receive and guide the cutting device within one of the plurality of slots.

3. The cutting apparatus of claim 1, wherein the base further includes a handle extending from an outer edge of the base.

4. The cutting apparatus of claim 1, wherein the base further includes a platform.

5. The cutting apparatus of claim 4, wherein the platform includes a first level and a second level, wherein an outer circumference of the first level is greater than an outer circumference of the second level.

6. The cutting apparatus of claim 5, wherein the outer circumference of the second level of the platform includes a wave pattern.

7. The cutting apparatus of claim 6, wherein the wave pattern on the outer circumference of the second level of the platform engages with the wave pattern on the circumference of the rim of the first cutting body for releasably securing the first cutting body to the base.

8. The cutting apparatus of claim 1, wherein the apparatus further includes a second cutting body having a semispherical inner space for receiving an item to be cut, the second cutting body disposed within the inner space of the first cutting body.

9. The cutting apparatus of claim 8, wherein the second cutting body is releaseably engaged to the base.

10. The cutting apparatus of claim 8, wherein the second cutting body includes a plurality of radially arranged slots intersecting at a top surface of the second cutting body.

11. The cutting apparatus of claim 1, wherein the apparatus further includes an outer body having a semispherical shape forming an inner space for receiving the first cutting body.

12. The cutting apparatus of 11, wherein the outer body releaseably engages with the base.

13. The cutting apparatus of claim 1 wherein the first surface of the base is further configured to provide at least two discrete positions for the outer rim of the first cutting body when the first cutting body is disposed thereon.

* * * * *